United States Patent [19]

Fink

[11] 4,071,243

[45] Jan. 31, 1978

[54] STILT STRUCTURE

[76] Inventor: Lee Fink, 16591 Peale Lane, Huntington Beach, Calif. 92649

[21] Appl. No.: 701,285

[22] Filed: June 30, 1976

[51] Int. Cl.[2] ..... A63B 25/00

[52] U.S. Cl. ..... 272/70.1; D34/14 E

[58] Field of Search ..... 272/70.1, 70.2; 135/49, 135/72, 66; D34/14 E

[56] References Cited

U.S. PATENT DOCUMENTS

| | | | |
|---|---|---|---|
| 1,575,847 | 3/1926 | King | 272/70.1 |
| 2,409,365 | 10/1946 | Lamb | 135/72 |
| 2,503,733 | 4/1950 | Heller | 272/70.2 |
| 2,528,706 | 11/1950 | Osborn | D34/14 E |

FOREIGN PATENT DOCUMENTS

| | | | |
|---|---|---|---|
| 377,449 | 6/1926 | Germany | 272/70.1 |

OTHER PUBLICATIONS

Hi Sticks — Advertising brochure of Stoker Engineering, Tacoma, Wash. 1962.

*Primary Examiner*—Richard J. Johnson
*Attorney, Agent, or Firm*—William C. Babcock

[57] ABSTRACT

A pair of stilts in which each stilt includes a horizontally positionable elongate handle that has first and second ends from which first and second elongate members extend downwardly and upwardly. Each first elongate member terminates on the lower end in a projecting step that has a centered third member projecting downwardly therefrom. A pair of stilts of the above structure permits a user to elect either of two positions to be supported in an elevation thereon, the second members in a first position being disposed rearwardly of his shoulders, and the second members in a second position being situtated forwardly of his shoulders. The handles are of sufficient length as to so off set the first members and steps relative to the second members that a user occupies an upright position on the pair of stilts irrespective of whether the stilts are in the first or second position. The pair of stilts have bottom recessed resilient pads mounted on the lower ends thereof to minimize slippage. Pebbles and small stones when contacted by the pads tend to enter the recesses temporarily where they will not cause slippage of the stilts on the supporting surface. Due to the weight of the user being equally distributed on the centered third members, there is a minimum tendency of the pair of stilts to pivot transversely relative to the direction of travel when a user is supported in an elevated position on the pair of stilts.

8 Claims, 6 Drawing Figures

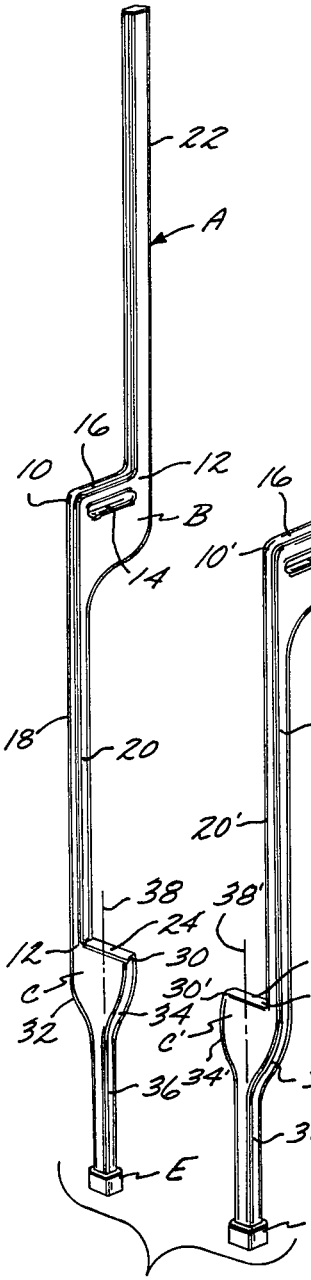
FIG. 1
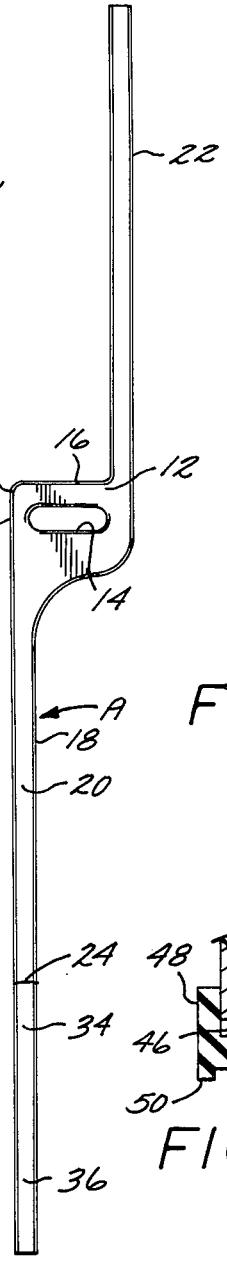
FIG. 2
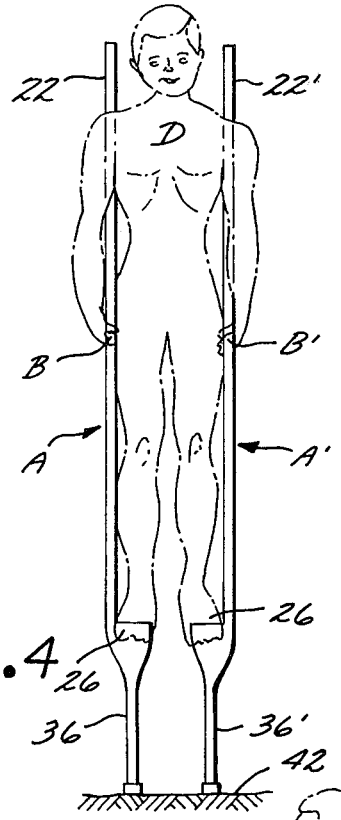
FIG. 4
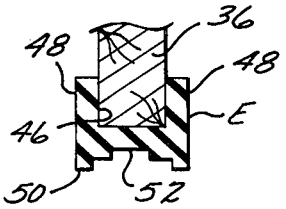
FIG. 6
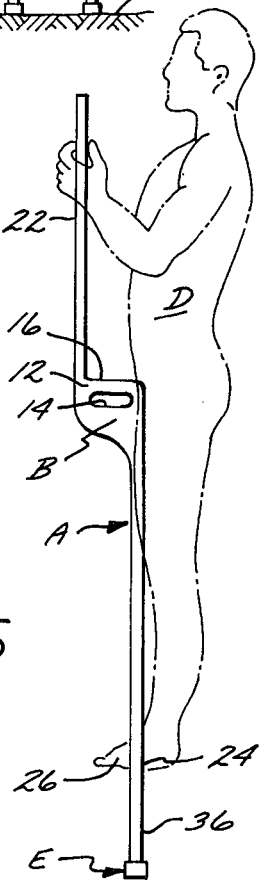
FIG. 5
FIG. 3
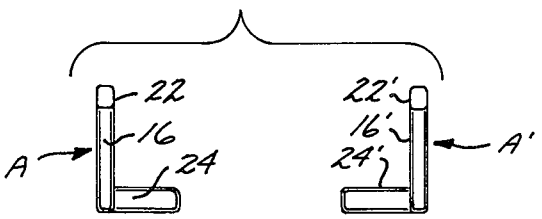

STILT STRUCTURE

BACKGROUND OF THE INVENTION

1. Field of the Invention

Stilt Structure.

2. Description of the Prior Art

Pairs of stilts have been used for many years by persons to walk in elevated positions for their amusement. However, such prior stilts have in the main been of relatively curde structure and unattractive in appearance. Also, previously available stilts required a substantial element of skill to use, as the weight of the person is distributed unevenly on the stilts, and the stilts have a tendency to pivot transversely relative to the direction of movement, and as a result falls from such stilts are not uncommon.

A major object of the present invention is to provide a pair of stilts that is attractive in appearance, are simple and easy to use, that permit the user to be mounted on the stilts in either a first or second position, and the weight of the user being so distributed on the stilts that the weight is centered relative to the supporting members of the stilts, and as a result the pair of stilts have little or no tendency to pivot transversely relative to the direction of movement when a user is supported in an elevated position on the stilts.

Yet another object of the invention is to provide a pair of stilts that are adapted to be fabricated as an integral unit from rigid materials such as wood or the like, or formed by various techniques from polymerized resins that may, if desired, be reinforced with suitable fiber.

SUMMARY OF THE INVENTION

A pair of stilts that may be utilized when in laterally spaced relationship to permit a user to walk in an elevated position. Each of the stilts includes an elongate handle that has a horizontally positionable upper edge and first and second edge portions. Each stilt includes a first elongate member that extends downwardly from the first end portion of the handle, when the upper edge of the latter is horizontally disposed. A second elongate member extends upwardly from the second end portion of the handle. A step is provided that is secured to the first end of the first elongate member, with the step defining a elongate edge surface on which a foot of a user may rest, with the edge surface being normally disposed to a first longitudinal side of the first member. A third elongate member is provided that extends downwardly from the step and is substantially centered relative to the edge surface of the step on which a foot of a user rests. Due to the third member being centered relative to the edge surface of the step previously identified, there is little tendency for the pair of stilts to tend to pivot transversely relative to the direction in which the user of the stilts is traveling, and as a result a user with little experience on stilts may manipulate the same safely. The pair of stilts due to the structure thereof may be used in either first or second positions by a person. The stilts when used in the first position have a second elongate member extending upwardly rearwardly of the shoulders of the user, and the stilts when employed in a second position having the second elongate members disposed forwardly of the shoulders of the user. The first and second stilts that comprise a pair, are identical, other than in the direction in which the step extend relative to the handles. The pairs of stilts may be fabricated from any desired rigid materials, such as wood, polymerized resins, or light weight metals such as aluminum, magnesium, and the like.

BRIEF DESCRIPTION OF THE DRAWING

FIG. 1 is a perspective view of a pair of first and second stilts;

FIG. 2 is a side elevational view of the first stilt;

FIG. 3 is a top plan view of the pair of first and second stilts shown in FIG. 1;

FIG. 4 is a front elevational view of a pair of the first and second stilts when employed by a user, and the stilts disposed in a first position;

FIG. 5 is a side elevational view of the stilts with a user in a second upright position thereon, and the user grasping the forwardly off set second elongate members with his hands; and FIG. 6 is a vertical cross-section view of an anti-slip resilient pad that is mounted on the lower end of a third elongate member, said pad having a circumferential lower edge portion that temporarily deforms to an arcuate configuration as the pad pivots relative to the ground surface, and the pad having a central upwardly extending recess into which pebbles and small stones move when the latter are contacted by the lower surface of the pad.

DESCRIPTION OF THE PREFERRED EMBODIMENT

The invention as may be seen in FIG. 1 includes a first stilt A and second stilt A′ that are employed as pairs by a user D as shown in FIGS. 4 and 5. The first stilt A includes an elongate horizontally positionable handle B that has a first end portion 10 and second end portion 12, with the handle having an elongate slot 14 defined therein. The handle B has an elongate convex upper edge surface 16 that may be grasped by the hand of a user when the fingers of a user extend through the slot 14 as shown in FIG. 4.

In FIG. 1 it will be seen that a first elongate member 18 extends downwardly from the first end portion 10 of handle B. The first elongate member 18 has a longitudinally extending side 20. The second elongate member 22 extends upwardly from a second end portion 12 of the handle B.

A step C is provided that is secured to the lower end of the first elongate member 18, with the step defining a horizontal supporting surface on which a foot 26 of the user D may rest as shown in FIG. 4. The surface 24 has a first end 28 and second end 30. Tapered edge surfaces 32 and 34 extend downwardly from the supporting surface 24 and merge on their lower end into a third elongate member 36, which member has the center line 38 thereof substantially centered relative to the horizontal foot supporting surface 24 of the step C. The second stilt A′ is identical in structure to the first stilt A other than the positioning of the step C′ relative to the handle B′. In FIG. 1 it will be noted that the step C projects to the right relative to the handle B, while in the second stilt A′ shown in FIG. 1 the step C′ projects to the left relative to the handle B′. Due to this structure, the first and second stilts provide steps C and C′ on which the feet 26 of the user D may rest, when the first and second stilts A and A′ are disposed in laterally spaced relationship as shown in FIGS. 4 and 5.

In FIG. 4 it will be seen that the stilts are being used in a first position as illustrated in FIG. 1, with the second elongate members 22 and 22′ being disposed rearwardly of the shoulder of the user D. In FIG. 5 the user D is employing the stilts A and A′ in a second position, and in the second position the second elongate members 22 and 22′ are disposed forwardly of the shoulders of the user D. Irrespective of whether the pair of stilts A and A′ are used in the first position as shown in FIG. 4 or the second position shown in FIG. 5, the pair of stilts provide the same operational advantages previously identified relative to the ease with which they may be used by a user D having little or no past experience in manipulating a pair of stilts, and walking at an elevated position over a desired ground surface.

The lengths of the handles B is such as to so off set the second elongate members 22 relative to the first elongate members 18 and steps C that the user occupies an upright position on the pair of stilts A and A′ irrespective of whether the user is in the first position shown in FIG. 4 or the second position illustrated in FIG. 5. In the first position shown in FIG. 4 the hands 40 of the user grasp the handles B. However, when the stilts A and A′ are in the second position shown in FIG. 5 the handles B and B′ extend rearwardly, and it is necessary for the user D to have his hands 40 grasp the second elongate members 22 and 22′ that are forwardly disposed and adjacently situated to his chest.

To allow a user D to run, ascend inclined surfaces, descend downwardly sloping surfaces and to compete in various maneuvers when mounted on a pair of the stilts A and A′, it is necessary that the stits not slip or slide relative to the surface 42 on which they are supported.

To minimize such slippage it is desirable to provide resilient pads E and E′ that are of identical structure, and that engage the lower end portions of the third elongate members 36 and 36′. Inasmuch as the pads E and E′ are identical only the pad E has been illustrated in FIG. 6.

The pad E is in the form of a cup that has a downwardly extending cavity 46 therein of such transverse cross-section as to snugly and frictionally engage the lower end portion of third elongate member 36. Pad E has sidewalls 48 that on their lower edges develop into a bottom 50 that has a series of progressively deeper recesses 52 extending upwardly therein. Should the pad E contact a pebble stone (not shown) the pebble or small stone will move temporarily into the recesses 52, and will not cause the pad to slip or slide on the supporting surface 42. The pad E is formed from a resilient material such as rubber or the like. When the resilient pad E pivots relative to the supporting surface 42, it will be seen that the lower adjacent sections of the side wall 48 and bottom 50 temporarily deform to the arcuate shape shown in phantom line in FIG. 6.

The use and operation of the invention as well as the structure and design thereof, has previously been explained in detail, and further description in this regard is not necessary.

I claim:

1. A pair of stilts that permit the user thereof to walk over a ground surface on said stilts, with said stilts being in either a first or a second position, with each of said stilts including:

a. an elongate handle that has a horizontally positionable upper edge and first and second portions;

b. a first elongate member having a second end secured to said handle, said member being vertically disposed when said upper edge is horizontally positioned, with said first elongate member having a longitudinally extending side and a first end;

c. a second elongate member that extends outwardly from said second end portion and is upwardly disposed when said upper edge is horizontally positioned;

d. A step secured to said first end of said first member, said step defining an elongate edge surface on which a foot of a user may rest, said edge surface being disposed perpendicular relative to said longitudinal side of said first member and to said handle; and e. a third elongate member that extends outwardly from said step and is substantially centered relative to said edge surface, with said third member being downwardly positioned when said upper edge of said handle is horizontally positioned and said second member is vertically positioned, with said pair of stilts being capable of supporting said user when said pair of stilts are in either the first or second positions, with said pair of stilts being in a first position when they are laterally spaced to have said steps project towards one another and said second members extend upwardly to the rear of the shoulders of said user, and which stilts occupy said second position when the positions of said stilts are reversed from that position which they are occupied in said first position when each stilt is rotated one hundred and eighty degrees, with said steps in said second position projecting towards one another and said second members are disposed forwardly of the shoulders of said user.

2. A pair of stilts as defined in claim 1 in which each of said handles has an elongate slot defined therein parallel to said upper edge of said handle and through which slot the fingers on a hand of said user extend when said hand is grasping said handle.

3. A pair of stilts as defined in claim 1 in which said handle, first and second elongate members, step and third elongate member of each of said stilts is formed from a rigid material and as an integral unit.

4. A pair of stilts as defined in claim 1 in which said steps of each of said stilts includes first and second oppositely disposed side edges that taper downwardly and inwardly to merge into said third elongate member.

5. A pair of stilts as defined in claim 1 in which said handles are of sufficient length as to off set said second elongate members relative to said first elongate members and steps that said user may occupy a straight upright position irrespective of whether said pair of stilts are in said first or second positions.

6. A pair of stilts as defined in claim 1 which each of said stilts in addition includes;

f. resilient means mounted on the lower extremity of said third elongate member to prevent said stilt slipping or sliding when said resilient means encounters a small pebble.

7. A pair of stilts as defined in claim 1, in which said resilient means is in the form of a cup that has a downwardly extending cavity that snugly and frictionally engage the lower end portion of said third elongate member, said cup including a bottom in which at least one upwardly extending recess into which said pebble may temporarily move to prevent said cup sliding on said pebble.

8. A pair of stilts as defined in claim 1 in which said cup has a side wall, and a peripheral edge portion of said cup at the junction of said side wall and bottom deforming temporarily to an arcuate slope when said cup pivots relative to a supporting surface with which it is in pressure contact.

* * * * *